US007963410B2

(12) United States Patent
Joergensen et al.

(10) Patent No.: US 7,963,410 B2
(45) Date of Patent: Jun. 21, 2011

(54) CONTAINER FLOOR PLATE, IN PARTICULAR FOR A REFRIGERATED CONTAINER

(75) Inventors: Gert Joergensen, Aabenraa (DK); Lars Lübker, Haderslev (DK)

(73) Assignee: Maersk Container Industri AS, Tinglev (DK)

( * ) Notice: Subject to any disclaimer, the term of this patent is extended or adjusted under 35 U.S.C. 154(b) by 809 days.

(21) Appl. No.: 11/871,392

(22) Filed: Oct. 12, 2007

(65) Prior Publication Data

US 2008/0120933 A1 May 29, 2008

(30) Foreign Application Priority Data

Oct. 17, 2006 (DE) ..... 10 2006 049 482

(51) Int. Cl.
*B65D 88/00* (2006.01)

(52) U.S. Cl. ..... 220/1.5; 220/592.2

(58) Field of Classification Search ..... 220/1.5, 220/592.2

See application file for complete search history.

(56) References Cited

U.S. PATENT DOCUMENTS

| | | | | |
|---|---|---|---|---|
| 2,753,018 A | | 7/1956 | Curell | 189/34 |
| 2,923,384 A | | 2/1960 | Black | 189/34 |
| 2,952,341 A | | 9/1960 | Weiler | 189/34 |
| 3,229,438 A | | 1/1966 | Flagan | 52/588 |
| 4,091,743 A | | 5/1978 | Lemon | 105/375 |
| 4,531,278 A | * | 7/1985 | Boykin | 29/469 |
| 5,170,605 A | | 12/1992 | Huddle | 52/588 |
| 5,285,604 A | | 2/1994 | Carlin | 52/79.1 |
| 5,449,081 A | | 9/1995 | Sjostedt et al. | 220/1.5 |
| 5,678,715 A | | 10/1997 | Sjostedt et al. | 220/1.5 |
| 5,730,485 A | | 3/1998 | Sjostedt et al. | 296/182 |
| 5,979,684 A | | 11/1999 | Ohnishi et al. | |
| 7,111,752 B2 | | 9/2006 | Bucher et al. | 220/592.2 |
| 2004/0031794 A1 | | 2/2004 | Bucher et al. | 220/4.01 |
| 2006/0081628 A1 | | 4/2006 | Myers et al. | 220/1.5 |

FOREIGN PATENT DOCUMENTS

| | | |
|---|---|---|
| DE | G 94 19 348.7 | 3/1995 |
| WO | WO88-07485 A1 | 10/1988 |
| WO | WO95-15289 A1 | 6/1995 |

* cited by examiner

*Primary Examiner* — Anthony Stashick
*Assistant Examiner* — Harry A Grosso
(74) *Attorney, Agent, or Firm* — McCormick, Paulding & Huber LLP

(57) ABSTRACT

The invention concerns a container floor plate (1), in particular for a refrigerated container, with an upper floor layer (2), a lower floor layer (3) and an intermediate insulating layer (8), support blocks (9) being located between the upper floor layer (2) and the lower floor layer (3). The purpose of the invention is to obtain a good insulation with a small mass. For this purpose, the lower floor layer (3) is provided with several transversal supports (10, 11), each support block (9) being supported on a transversal support (10).

15 Claims, 1 Drawing Sheet

CONTAINER FLOOR PLATE, IN PARTICULAR FOR A REFRIGERATED CONTAINER

CROSS REFERENCE TO RELATED APPLICATIONS

Applicant hereby claims foreign priority benefits under U.S.C. §119 from German Patent Application No. 10 2006 049 482.2 filed on Oct. 17, 2006, the contents of which are incorporated by reference herein.

FIELD OF THE INVENTION

The invention concerns a container floor plate, in particular for a refrigerated container, with an upper floor layer, a lower floor layer and an intermediate insulating layer, support blocks being located between the upper floor layer and the lower floor layer.

BACKGROUND OF THE INVENTION

Such container floor plates are, for example, known from WO 88/07485 A1. In this document the upper floor layer is described to be formed by several panels arranged next to each other in parallel to the longitudinal direction of the container, the panels having a number of T-shaped projections also extending in parallel to the longitudinal direction and pointing upwards. The upper surfaces of these T-shaped projections form the "floor" of the container. Between the projections channels remain, through which the cooling air can be guided.

Support blocks made of foam with high density are located between the upper floor layer and the lower floor layer. These support blocks serve as distance pieces during manufacturing of the floor plate. The distance pieces are placed on the lower floor layer. The upper floor layer is placed on the distance pieces. This construction is then placed in a hydraulic press. The hollow space remaining between the upper floor layer and the lower floor layer is then filled with foam that has, in the solid state, approximately the same density as the support blocks. On its lower side, the lower floor layer forms open tunnels, into which the tines of a fork lift can be inserted.

For many years, containers have been used for transporting goods all over the world. Containers have the advantage that they can be transported on both ships, railway wagons and trucks, so that a shift between different transport systems can be made without requiring the unloading of the goods transported in containers.

In many cases, the outer measurements of such containers are standardised. A typical container has a cuboid or box shape, meaning that it has two end walls, two side walls, a roof plate and a floor plate. Usually a door arrangement is located in at least one end wall. The entire container is mechanically stiffened by a frame structure, so that several containers can be stacked. At each end wall the frame structure has a support frame, the support frames being connected to each other by means of two or four longitudinal beams.

Two longitudinal beams extend along the lower edge of the two side walls. The floor plate is connected to the longitudinal beams, the force transmission being realisable in different manners. Typically, a container must be able to stand relatively large point loads of up to 7.5 t. Fittings for fixing the container on ships, trucks, railway wagons, or for fixing the containers to each other, are located at the corners of the container.

The first containers had floor plates, where boards or beams were supported on transversal metal supports having a C-shaped cross-section. The ends of the transversal supports were welded onto the longitudinal supports. This construction was also used in the first generation of refrigerated containers, the wooden floor plates eventually being replaced by a sandwich-construction of a so-called T-floor, an insulating layer and a lower floor layer. The T-floor has several T-shaped profiles arranged next to each other, whose upper surfaces form the floor of the container that is visible from above, channels for cooling air being formed between the T-profiles.

In principle such a construction is known from DE 94 19 348 U1. The lower floor layer is formed by a wave-like profile, in which, compared to a regular wave profile, some waves have been left out. The upper floor layer is supported by the lower floor layer via the insulating layer. The consequence of this is that the insulating layer also has to carry the weight of the goods transported in the container and accordingly has to be rather solid. This again results in reduced insulating properties.

WO 95/15289 A1 shows a different refrigerated container, in which an insulating foam layer is also arranged between the upper floor layer and the lower floor layer. Also here the insulating layer must be able to carry the entire load.

U.S. Pat. No. 5,979,684 shows a freight container, in which the floor plate and other components are made of a fibre-reinforced plastic material, the fibre-reinforced plastic material surrounding a core of plastic foam. For the support of the upper layer of the fibre-reinforced plastic material by the lower layer of fibre-reinforced plastic material, I-shaped, C-shaped and Z-shaped profiles made of a fibre-reinforced plastic material are provided. In the direction of the load, however, these profiles have a relatively poor rigidity, so that also here the core originally foreseen for insulation purposes must have a sufficient load-carrying capacity. The demands on the carrying properties and the demands on the insulation properties contrast with each other.

In the known constructions, the sandwich of upper floor layer, insulating layer and lower floor layer is susceptible to delamination. If the bonding between the layers fails, the rigidity and the strength of the floor are substantially impaired. This can, for example, be caused by ingressing humidity and is a frequent reason for repair work on known containers.

SUMMARY OF THE INVENTION

The invention is based on the task of providing a good insulation with a small mass.

With a container floor plate as mentioned in the introduction, this task is solved in that the lower floor layer is provided with several transversal supports, each support block being supported on a transversal support.

The transversal supports stiffen the lower floor layer, so that the lower floor layer is able to receive the forces incurred via the support blocks without suffering from significant deformation. A delamination is not critical, as the load force of the upper floor layer is transferred through the support blocks to the transversal supports and from there into the longitudinal supports. Thus, the insulating layer no longer has to be dimensioned in consideration of the stability of the floor.

It is preferred that the transversal supports are parts of the lower floor layer. This simplifies the manufacturing of the floor plate, as the transversal supports will not require additional handling.

It is preferred that the transversal supports are made as stiffening profiles of the lower floor layer, said profiles having several transversally extending flanks, and that each support block is located next to at least one flank. The major share of the force led into the lower floor layer and/or a longitudinal support is then transferred via the flank. This is a particularly simple way of counteracting a deformation of the lower floor layer.

Advantageously, the support block is allocated to two flanks, a distance between the two flanks in the longitudinal direction being maximum 40% larger than an extension of the support block in this direction. Thus, it is ensured that the area between the two flanks is too short to be significantly deformed. The force transferred from the upper floor layer via the support block into the lower floor layer and/or the longitudinal support is thus with a high reliability transferred via the flanks.

Preferably, the flank is inclined in relation to a plane of the upper floor layer by an angle in the range from 45° to 90°. Particularly advantageous is an angle in the range from 70° to 80°. In this range sufficiently large forces can be transferred via the flank to the lower floor layer and/or the longitudinal support without causing significant deformation of the lower floor layer.

It is also advantageous that the stiffening profile is made to be bowl-shaped and open upwards. Such a profiling gives a height advantage in relation to an I- or a C-profile.

Preferably, the stiffening profile has a depression between two elevations. This means that the stiffening profile is made to have several groups, each group having two transversally extending elevations between which a depression is located. Thus, the lower floor layer is only stiffened in the areas to which forces from the upper floor layer are transferred via the support blocks.

It is advantageous that the stiffening profile is made of profiled sheet metal. This is a simple and cost-effective way of achieving the required load-carrying capacity.

It is preferred that the depression has a bottom that is placed lower than a main plane of the lower floor layer. The main plane of the lower floor layer is the plane extending between the groups formed by two elevations and one depression. This means that the depressions project downwards from the lower floor layer. This has the advantage that the bottom sides of the depressions can be used as supporting points, on which the container rests, for example, during transport on a truck or when left in a parked position. By means of the depressions formed in this way it can, for example, be achieved that the container always has a distance in the range from 60 to 100 mm, preferably in the range from 80 to 90 mm, from the ground. The weight of the goods in the container will then be transferred exactly to these supporting points, as the support blocks are located on the elevations immediately next to the depressions. The design of the lower floor layer with such a depression that projects downwards from the rest of the lower floor layer can also be used independently of the design of the remaining floor plate, if the upper floor layer is supported via the insulating layer or otherwise. However, specific advantages are achieved when using the support blocks mentioned above.

Preferably, each transversal end of the depression comprises an end wall that extends at least up to the main plane. Thus, it is ensured that with a floor plate projecting downwards no dirt or other unwanted substances can get into the depressions at the transversal ends. During manufacturing the end walls involve the advantage that they prevent insulating foam from escaping.

It is preferred that the end wall is inclined outwards and upwards. Thus, each depression forms a downward directed pyramid trunk with a rectangular base surface. This prevents dripping fluids from gathering somewhere and eventually flowing into the inside of the depression.

It is advantageous that at least one section of the lower floor layer between stiffening profiles is made of a different material than a stiffening profile. Then, the lower floor layer can be made with a smaller weight, if the sections are made of a lighter material. Also, costs can be saved, if this material is cheaper than the material of the stiffening profiles.

It is also preferred that, compared to the insulating layer, the support blocks have a larger deformation resistance towards a load acting from the upper floor layer in the direction of the lower floor layer. In other words, the support blocks are harder than the material of the insulating layer. A consequence of this is that the force acting upon the upper floor layer is transferred to the lower floor layer via the support blocks. Thus, the insulating layer does not have to be dimensioned in consideration of a load-carrying capacity. On the contrary, the insulating layer can practically be optimised exclusively in consideration of the insulating properties. This enables the use of an insulating material that is softer and thus has better insulating properties, meaning that material and mass can be saved. The support surfaces formed by the support blocks can be located further apart, as they are no longer required to serve as distance pieces when foaming the insulating layer. This also saves mass.

Preferably, the deformation resistance of the support block is larger than the deformation resistance of the insulating layer by at least the factor 20. In many cases it is even favourable to make the deformation resistance of the support blocks larger than the deformation resistance of the insulating layer by the factor 50 to 60. This means that the support blocks are 50 to 60 times harder than the insulating layer. When a load acts upon the support blocks via the upper floor layer, the support blocks are much less compressed than the insulating layer. In fact, even no or no noticeable deformation of the insulating layer occurs. This counteracts a delamination. This increases the life of the container floor plate and thus of the whole container. The lower limit of the deformation resistance is also determined by the relation of the support area of the support blocks to the remaining area, which is filled by insulating material.

Preferably, the insulating layer is made of plastic foam. This involves the advantage that the upper floor layer, the support blocks and the lower floor layer can be assembled before the insulating layer is foamed in. Thus, it can be ensured that the space between the upper floor layer and the lower floor layer is actually filled with the required insulating material.

Preferably, the support block is connected to the transversal support by at least one fitting. This simplifies the manufacturing. The support block can be fixed on the transversal support before inserting the insulating layer. When the insulating layer has been inserted, the support block is anyway fixed between the upper floor layer and the lower floor layer by the insulating layer.

Preferably, the bottom side of the lower floor layer is a closed surface. This means that no projections exist, where dirt could gather.

It is advantageous that the support blocks are made of a plastic material, wood, ceramics, a mineral material, glass or a compound of two or more of these materials, particularly of substantially equal shares of polyethylene and wood fibres. Small masses of these materials provide a sufficient supporting effect. As the support blocks are mainly loaded by pressure, the stability of these materials is sufficient.

BRIEF DESCRIPTION OF THE DRAWINGS

In the following the invention is explained by means of a preferred embodiment in connection with the drawings, showing.

DETAILED DESCRIPTION OF THE INVENTION

Figure 1:
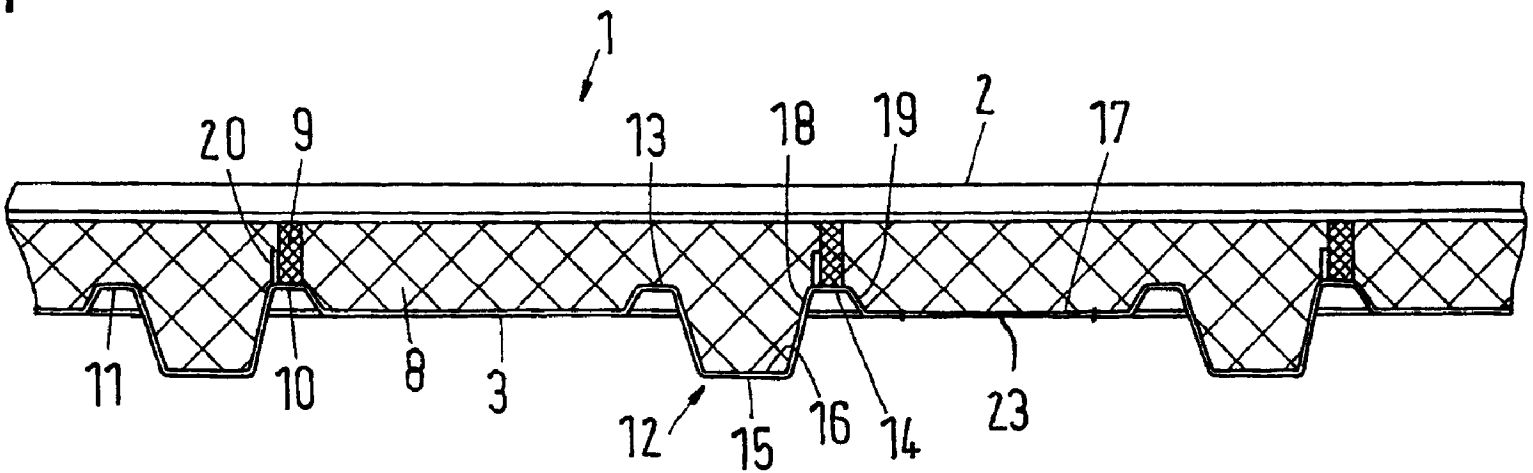
FIG. 1 shows a container floor plate in a section I-I according to FIG. 2.
Figure 2:
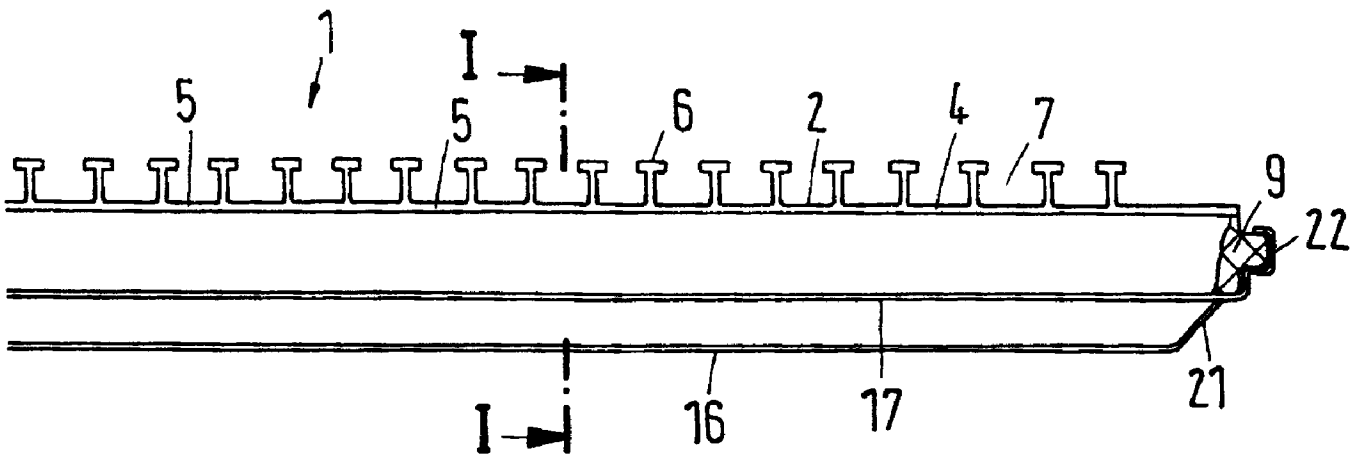
FIG. 2 is a front view of the container floor plate, partially in section.

A typical container, for example with a length of 20 feet or 40 feet, has the shape of a cuboid. The cuboid has two side walls and two end walls, one of which is usually provided with a lockable opening. A roof plate is located at the top of the cuboid. The bottom of the container is formed by a floor plate 1, which will be described in the following.

The floor plate 1 has an upper floor layer 2 and a lower floor layer 3. The upper floor layer 2 comprises a plate 4, which is in some cases assembled of several sections that are joined with each other at welding points 5. T-shaped projections 6 project upwards from the plate 4. Channels 7 are formed between neighbouring T-shaped projections 6, said channels 7 permitting the flow of cooling air. The plates 4 with the projections 6 can, for example, be made of extruded aluminium. Due to the projections 6, such an upper floor layer 2 has a relatively large stability in the longitudinal direction.

An insulating layer 8 is located between the upper floor layer 2 and the lower floor layer 3, the insulating layer 8 being, for example, formed by a plastic foam. The plastic foam can be generated in situ, that is, when the upper floor layer 2 and the lower floor layer 3 have already been located in their relative alignment to each other.

Several support blocks 9 are located between the upper floor layer 2 and the lower floor layer 3. The support blocks 9 have a substantially larger deformation resistance than the insulating layer 8. The deformation resistance of the support blocks 9 is larger than the deformation resistance of the insulating layer 8 by at least the factor 20. Preferably, the deformation resistance of the support blocks 9 is larger than the deformation resistance of the insulating layer 8 by the factor 50 to 60. Accordingly, a load acting upon the upper floor layer 2 is practically completely received by the support blocks 9. The insulating layer 8 does not have to carry any load. Thus, it is possible to dimension the insulating layer 8 exclusively in consideration of the insulating effect. The load-carrying capacity plays practically no role. Accordingly, the insulating layer 8 can be made relatively soft and with a high share of air, so that its insulating effect is optimised. The insulating layer can also be made thinner to keep the total thickness of the floor plate small.

The lower floor layer 3 has several transversal supports 10, 11, which are formed by a stiffening profile 12 of the lower floor layer 3. This means that the lower floor layer 3 is bent into a wave-like shape. Each support block 9 rests on a transversal support 10, which again rests on a longitudinal support 22.

Each stiffening profile 12 has two elevations 13, 14 and between these a depression 15. Thus, the stiffening profile 12 forms the transversal supports 10, 11, for example, of profiled sheet metal, the profile being bowl-shaped and open upwards. This gives a height advantage in comparison with I-supports or C-supports. The depression 15 has a bottom 16, which is placed lower than a main plane 17 of the lower floor layer 3. Accordingly, the bottom 16 of the depression 15 projects about 60 to 100 mm downwards from the main plane 17. When the container is stabled, it rests on the bottoms 16 of the depressions 15, so that the remaining components of the lower floor layer 3 are not damaged.

Each elevation 13, 14 has two flanks 18, 19. A distance between the flanks 18, 19 in the longitudinal direction of the floor plate 1, that is, from the left to the right in FIG. 1, is maximum 40% larger than the extension of the support block 9 in the same direction. The support blocks 9 are arranged to be relatively close to the flank 19, so that the forces acting upon the support block 9 are transferred to the longitudinal support 22 via the flank 19. Thus it is ensured that also large forces usually permitted in connection with a container can be absorbed without deforming the lower floor layer 3. The flanks 18, 19 are inclined with respect to a plane of the upper floor layer 2, which is parallel to the main plane 17 of the lower floor layer 3, by an angle in the range between 45° to 90°. The inclinations of the flanks 18, 19 may differ. For example, the flank 18 facing the depression may be steeper, that is, form a larger angle with the main plane 17 than the flank 19.

Each support block 9 is connected to the transversal profile 10 by means of a fitting 20. This simplifies the manufacturing. First the lower floor layer 3 is manufactured and then the support blocks 9 are connected to the lower floor layer 3 by means of the fittings 20. Here, it can be advantageous first to connect the fittings 20 to the transversal supports 10 and then connect the relatively hard support blocks 9 to the fittings 20, for example by means of screws. Subsequently, the upper floor layer 2 is mounted and, if required, retained by a press to avoid that the upper floor layer 2 lifts off from the lower floor layer 3 during the subsequent foaming process.

As can be seen from FIG. 1, the insulating layer 8 also extends into the depressions 15. However, it is also possible to close the depressions 15 approximately at the height of the main plane 17, for example by fixing a sheet metal or the like by welding, so that the depressions 15 are kept free of the insulating means.

At the transversal ends each depression 15 has an end wall, which is inclined in the upward and the outward direction. Thus, the depressions 15 form a pyramidal frustrum with a rectangular base. This ensures that the risk that humidity gathers, dams up and then flows into the depressions 15 is relatively small.

The ends of the support blocks 9 extend into the U-shaped longitudinal supports 22, so that here they are further supported.

As the lower floor layer 3 is only punctually loaded, namely in the area of the transversal supports 10, it is also possible to skip sections of the lower floor layer 3 between the stiffening profiles 12. The remaining sections of the lower floor layer 3, that is, the area of the stiffening profiles 12, can then be connected by means of the longitudinal support 22, so that a sufficient support of the upper floor layer 2 occurs via the support blocks 9. If required, the bottom side of the insulating layer 8 can then be lacquered. Protection plates of a plastic material without support function can also be located here. In other words, the lower floor layer 3 can be made of different materials. A first material, for example profiled sheet metal, forms the stiffening profiles 12. A second material, for example plastic plates, forms the sections there between. In this way, weight and costs can be saved.

However, it is advantageous that the bottom side of the lower floor layer 3 is closed, as this will reduce the risk of damages, particularly damages to the insulating layer 8.

In a manner not shown in detail further blocks, additional to the support blocks 9, can be provided between the upper floor layer 2 and the lower floor layer 3, said further blocks, however, not resting on a transversal support and accordingly not being called support blocks.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A container floor plate comprising an upper floor layer, a lower floor layer and an intermediate insulating layer, support blocks being located between the upper floor layer and the lower floor layer, wherein the lower floor layer is provided with several transversal supports, each support block being supported on an elevation of a transversal support, the transversal supports are made as stiffening profiles of the lower floor layer, the stiffening profile comprises a depression between two elevations, and wherein the depression has a bottom that is placed lower than a main plane of the lower floor layer, said main plane of the lower floor layer extending between groups formed by two elevations and one depression.

2. The floor plate according to claim 1, wherein said profiles have several transversely extending flanks, and wherein each support block is located next to at least one flank.

3. The floor plate according to claim 2, wherein the support block is allocated to two flanks, a distance between the two flanks in the longitudinal direction being maximum 40% larger than an extension of the support block in this direction.

4. The floor plate according to claim 2, wherein the flank is inclined in relation to a plane of the upper floor layer by an angle in the range from 45° to 90° .

5. The floor plate according to claim 2, wherein the stiffening profile is bowl-shaped and open upwards.

6. The floor plate according to claim 2, wherein the stiffening profile is made of profiled sheet metal.

7. The floor plate according to claim 1, wherein each front side of the depression has an end wall that extends at least up to the main plane.

8. The floor plate according to claim 7, wherein the end wall is inclined outwards and upwards.

9. The floor plate according to claim 2, wherein at least one section of the lower floor layer between stiffening profiles is made of a different material than the stiffening profile.

10. The floor plate according to claim 1, wherein the support blocks have a larger deformation resistance than the insulating layer with respect to a load acting from the upper floor layer in the direction of the lower floor layer.

11. The floor plate according to claim 10, wherein the deformation resistance of the support block is larger than the deformation resistance of the insulating layer by at least the factor 20.

12. The floor plate according to claim 1, wherein the insulating layer is made of plastic foam.

13. The floor plate according to claim 1, wherein the support blocks are connected to the transversal support by at least one fitting.

14. The floor plate according to claim 1, wherein the bottom side of the lower floor layer is a closed surface.

15. The floor plate according to claim 1, wherein the support blocks are made of a plastic material, wood, ceramics, a mineral material, glass or a compound of two or more of these materials.

* * * * *